US007345565B2

(12) United States Patent
Yang et al.

(10) Patent No.: US 7,345,565 B2
(45) Date of Patent: Mar. 18, 2008

(54) TRANSFORMER STRUCTURE

(75) Inventors: Ching-Sheng Yang, Taipei (TW); Su-Hua Wu, Panchiao (TW); Shu-Chen Wang, Chung-Ho (TW)

(73) Assignee: Taipei Multipower Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 11/838,226

(22) Filed: Aug. 14, 2007

(65) Prior Publication Data

US 2007/0273466 A1 Nov. 29, 2007

Related U.S. Application Data

(63) Continuation-in-part of application No. 11/401,947, filed on Apr. 12, 2006, now abandoned.

(51) Int. Cl.
*H01F 5/00* (2006.01)

(52) U.S. Cl. ..... 336/200; 336/198

(58) Field of Classification Search ..... 336/65, 336/83, 192, 198, 200, 220–222, 232
See application file for complete search history.

(56) References Cited

U.S. PATENT DOCUMENTS 7,199,694 B2 * 4/2007 Hao ..... 336/208
7,218,199 B1 * 5/2007 Chang ..... 336/212
7,221,252 B1 * 5/2007 Chang ..... 336/212
7,301,430 B1 * 11/2007 Chan et al. ..... 336/200
2005/0073385 A1 * 4/2005 Wu et al. ..... 336/208
2005/0237145 A1 * 10/2005 Fushimi ..... 336/208
2006/0006974 A1 * 1/2006 Yang et al. ..... 336/208
2006/0255900 A1 * 11/2006 Kohno ..... 336/212

* cited by examiner

*Primary Examiner*—Tuyen T. Nguyen

(57) ABSTRACT

A transformer is disclosed to include two bobbin, each bobbin having a primary side and a secondary side respectively holding a primary winding and a secondary winding, two first ferrite cores respectively inserted through the bobbins, two second ferrite cores arranged at two sides relative to the bobbins and abutted against each other, each second ferrite core having a middle protruding portion respectively inserted into the bobbins and to form with the first ferrite cores two independent magnetic loops. The secondary side of each bobbin has winding spaces for the winding of the wire for the secondary winding, partition flanges, vacant spaces defined between each two adjacent partition flanges, and top bridging notches and bottom bridging notches respectively formed on the partition flanges in such a manner that each vacant space has one side in communication with one top bridging notch and an opposite side in communication with one bottom bridging notch for guiding the wire of the secondary winding from one winding space to another through the vacant space without causing a potential difference.

4 Claims, 9 Drawing Sheets

TRANSFORMER STRUCTURE

This application is a Continuation-In-Part of my patent application, Ser. No. 11/401,947, filed on Apr. 12, 2006.

BACKGROUND OF THE INVENTION

1. Field of the Invention

The present invention relates to transformers and more particularly, to an improved transformer structure, which provides an extended creepage distance at the secondary side to prevent formation of a potential difference and to enhance the voltage resistance strength.

2. Description of the Related Art

FIG. 7 illustrates a conventional high frequency transformer, which comprises an electrically insulative bobbin A, and two ferrite cores B. The bobbin A has wound thereon a primary winding A1 and a secondary winding A2. The bobbin A further has a plurality of partition flanges A21 that divide the secondary winding A2 into multiple secondary winding portions A24. The partition flanges A21 have a respective notch A22 at the same side for the passing of the wire of the secondary winding A2. Further, one vacant space A23 is defined between two partition flanges A21 around the periphery of the bobbin A corresponding to the connection area between the two ferrite cores B to reduce influence of magnetic field and to lower transformer loss.

FIG. 8 shows a double bobbin type high frequency transformer according to the prior art. According to this design, the transformer comprises two bobbins A, each bobbin A having wound thereon a primary winding A1 and a secondary winding A2, two first ferrite cores C1 respectively and axially inserted through the bobbins A, and an I-shaped second ferrite core C set between the two bobbins A with its two distal ends stopped between the first ferrite cores C1. The two first ferrite cores C1 form with the second ferrite core C two magnetic loops Ca and Cb. Because these two magnetic loops Ca and Cb commonly go through the second ferrite core C, they interfere with each other, resulting in unequal amount of electric current at the two lamp tubes that are respectively coupled to the output ends of the secondary windings A2 at the bobbins A, and therefore the two lamp tubes will have different brightness and the working life of the lamp tubes will be shortened.

The aforesaid prior art designs have the common drawbacks as follows:

1. When winding an wire on the bobbin A for the secondary winding A2, the wire must bridge each partition flange A21. When the shared voltage is excessively high, a potential different will occur at the bridging area to cause charging and discharging actions and to further produce an electric arc effect. In this case, the transformer may be burned out.
2. Bridging of the wire over the partition flanges A21 of the bobbin A may cause the secondary winding A2 to produce a potential difference that affects the voltage resistance of the transformer, thereby shortening the working life of the transformer.

Therefore, it is desirable to provide a transformer that eliminates the aforesaid drawbacks.

SUMMARY OF THE INVENTION

The present invention has been accomplished under the circumstances in view. It is therefore the main object of the present invention to provide a transformer, which extends the creepage distance at the secondary side of each bobbin to prevent formation of a potential difference and to enhance the voltage resistance strength. It is another object of the present invention to provide a transformer, which utilizes induction between the ferrite core set and the secondary winding at each bobbin to increase the leakage inductance and the coupling effect.

To achieve these and other objects of the present invention, the transformer comprises two bobbins, which hold a respective primary winding and a respective secondary winding, and an ferrite core set. The bobbins are electrically insulative, each comprising a center through hole axially extending through its two distal ends, a primary side and a secondary side defined around the periphery, a partition space defined around the periphery between the primary side and the secondary side, and a side through hole cut through the periphery in communication between the partition space and the center through hole. The secondary side comprises a plurality of partition flanges extending around the periphery of the bobbin, a plurality of winding spaces extending around the periphery of the bobbin and separated by the partition flanges, a plurality of vacant spaces defined between each two adjacent partition flanges around the periphery of the bobbin and separated by the winding spaces, a plurality of top bridging notches and bottom bridging notches respectively formed on the partition flanges such that each vacant space has one side in communication with one top bridging notch and the opposite side in communication with one bottom bridging notch. The ferrite core set comprises two first ferrite cores respectively inserted into the center through holes of the bobbins, and two E-shaped second ferrite cores respectively attached to the bobbins from two opposite sides, each having a middle protruding portion respectively inserted into the side through holes of the partition spaces to form the first ferrite core in each bobbin a respective independent magnetic loop.

DETAILED DESCRIPTION OF THE PREFERRED EMBODIMENT

Figure 1:
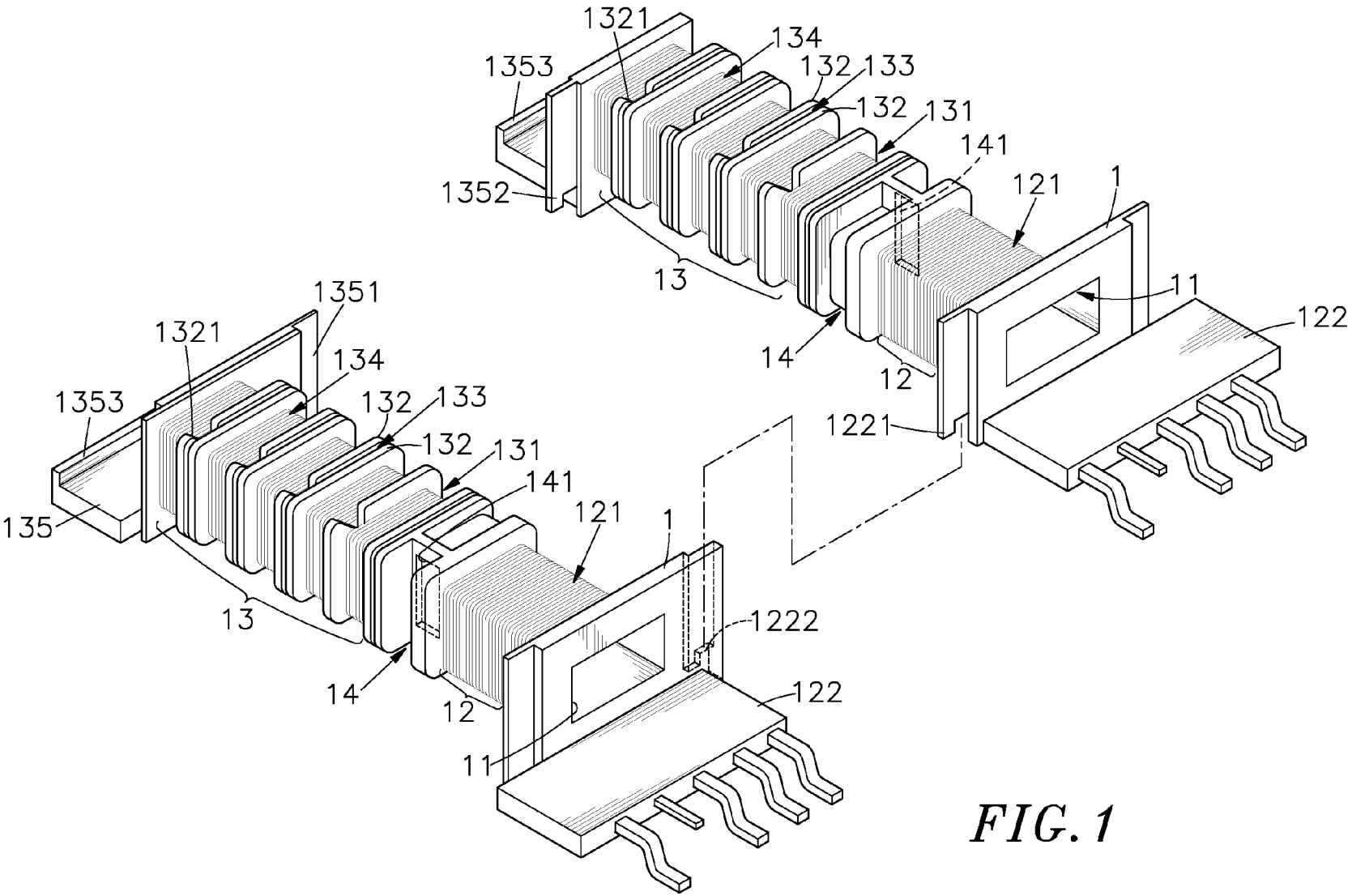
FIG. 1 is an exploded view of a part of a transformer in accordance with a first embodiment of the present invention.
Figure 2:
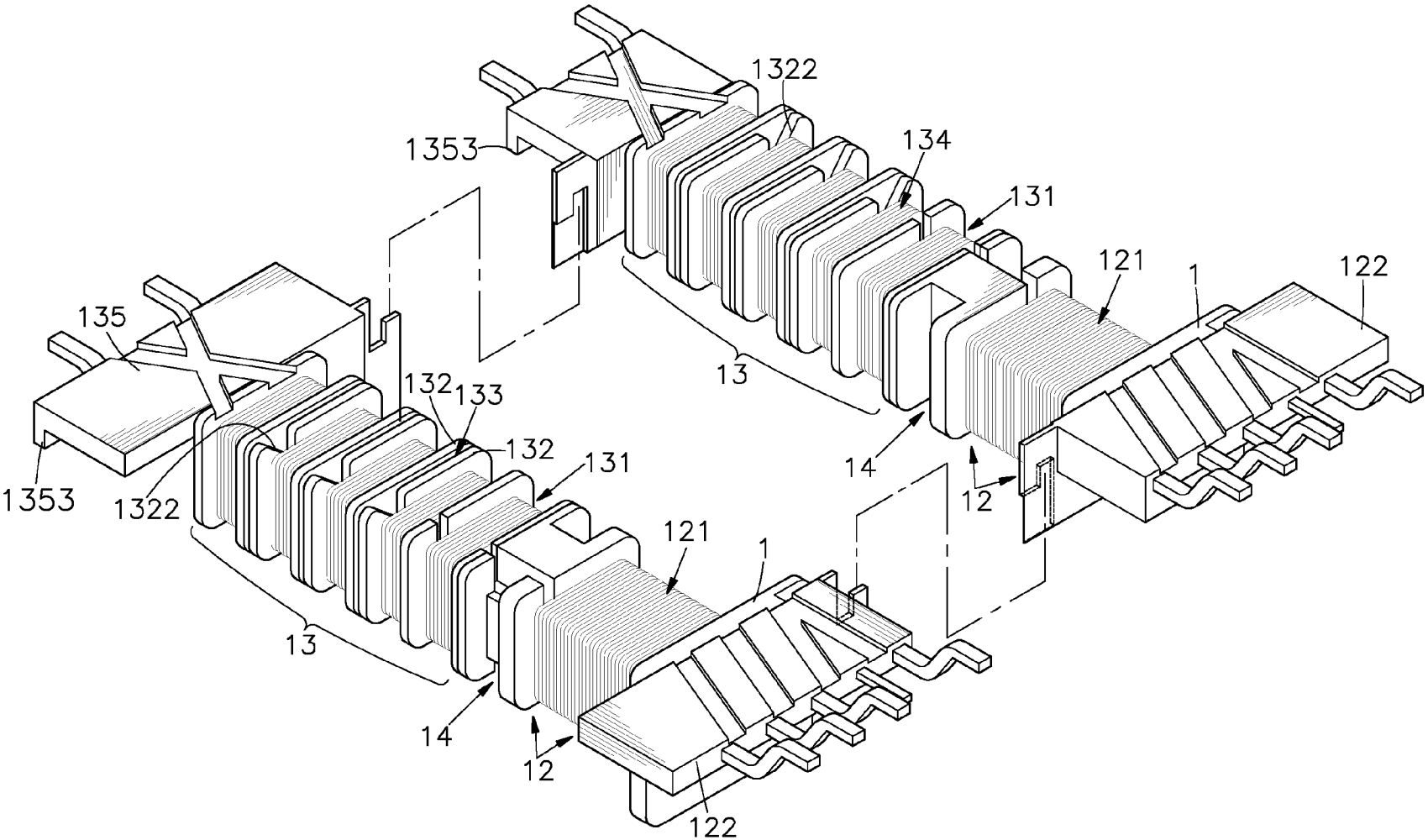
FIG. 2 is corresponds to FIG. 1 when viewed from another angle.
Figure 3:
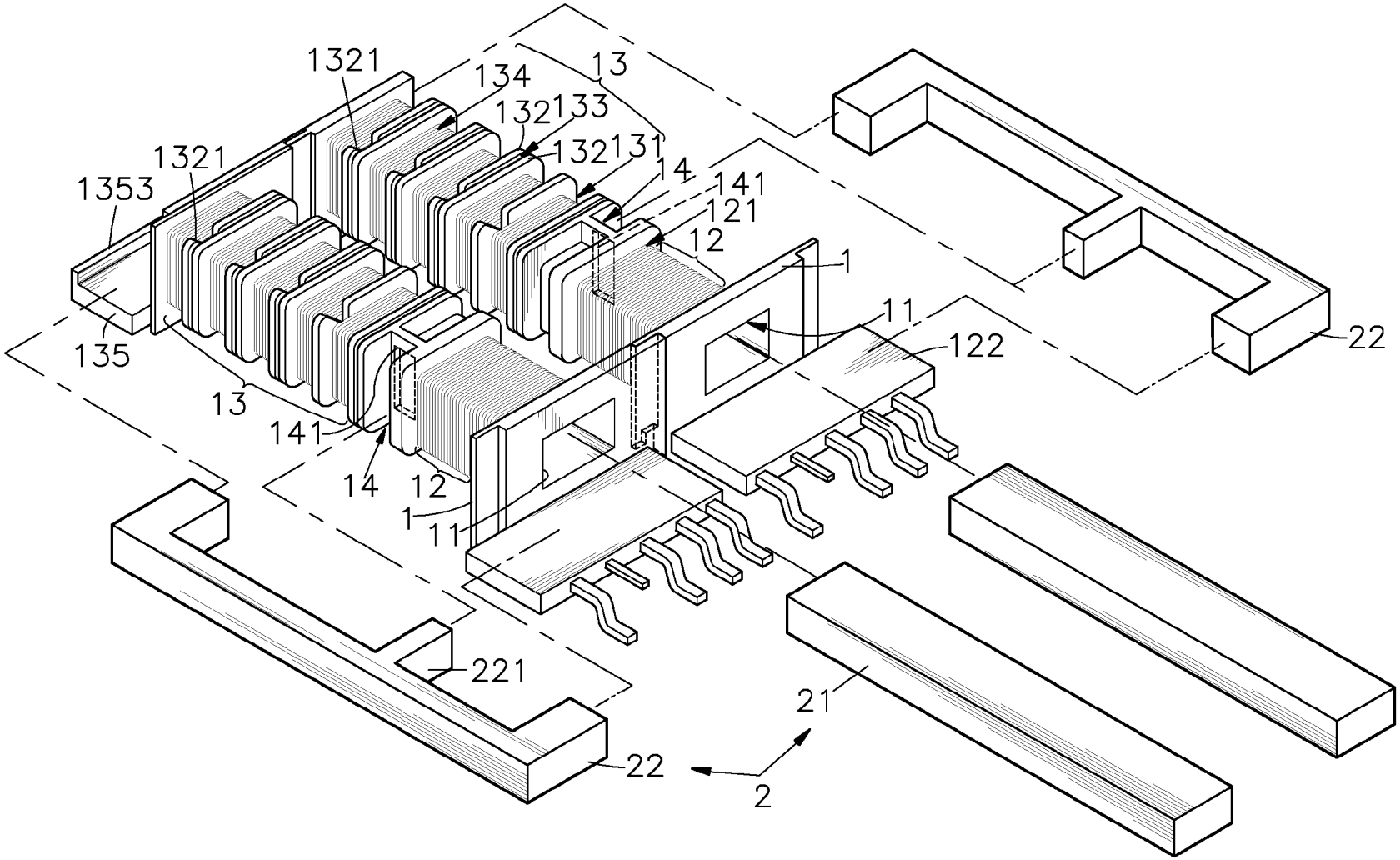
FIG. 3 is an exploded view of the transformer in accordance with the first embodiment of the present invention.
Figure 4:
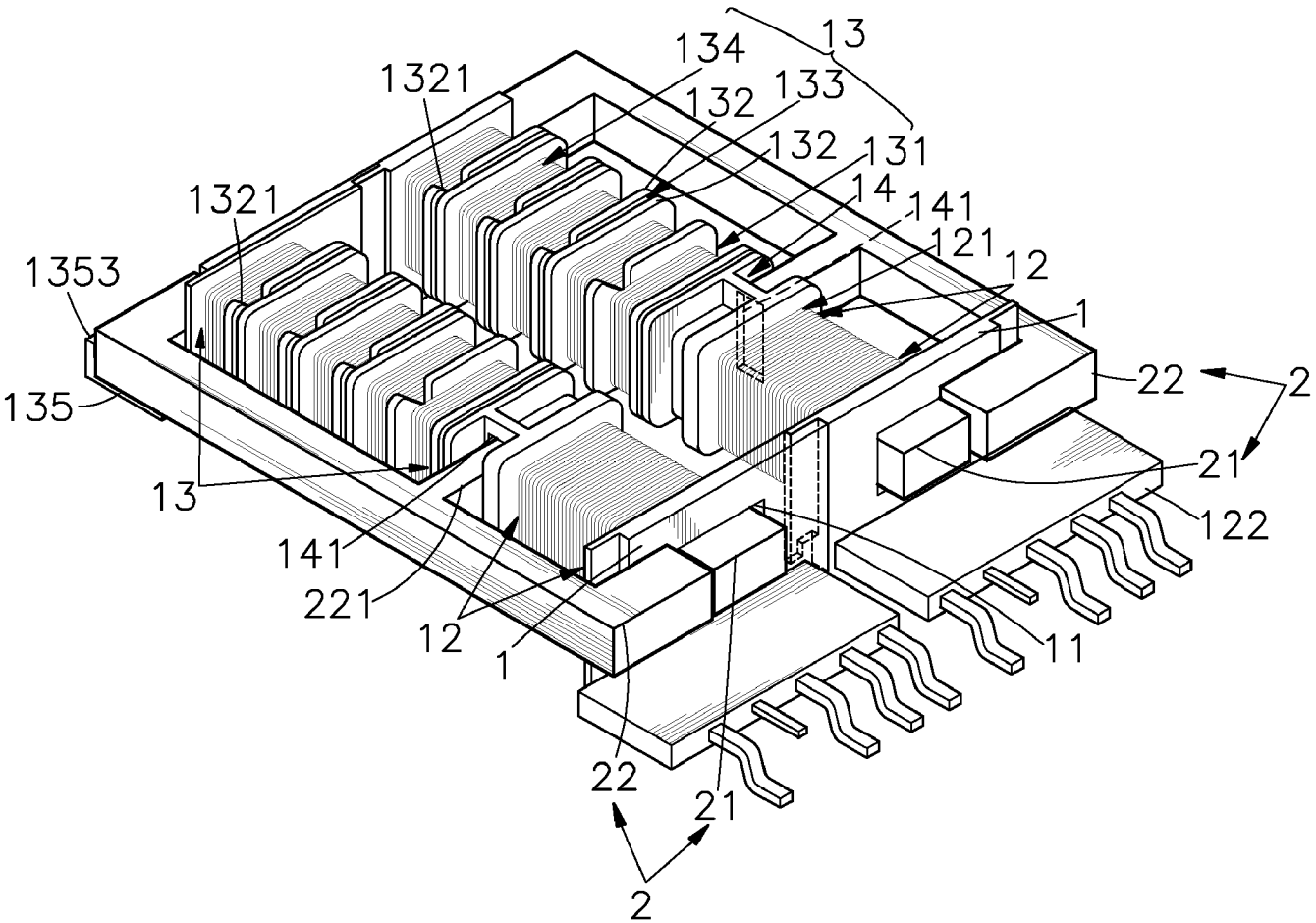
FIG. 4 is an assembly view of the transformer in accordance with the present invention.

Referring to FIGS. 1~4, a transformer in accordance with the present invention is shown comprised of two bobbins 1 and an ferrite core set 2.

The bobbins 1 are made out of an electrically insulative material. Each bobbin 1 comprises a center through hole 11 axially extending through its two distal ends, a primary side 12 and a secondary side 13 defined around the periphery, a partition space 14 defined around the periphery between the primary side 12 and the secondary side 13, a side through hole 141 cut through the periphery in communication between the partition space 14 and the center through hole 11, and two locating blocks, namely, a first locating block 122 and a second locating block 135 respectively and outwardly extending from the primary side 12 and the secondary side 13 in reversed directions. The secondary side 13 comprises a plurality of partition flanges 132 extending around the periphery of the bobbin 1 and arranged in parallel, a plurality of winding spaces 131 extending around the periphery of the bobbin 1 and separated by the partition flanges 132, a plurality of vacant spaces 133 defined between each two adjacent partition flanges 132 around the periphery of the bobbin 1 and separated by the winding spaces 131, a plurality of top bridging notches 1321 and bottom bridging notches 1322 respectively formed on the partition flanges 132 in such a manner that each vacant space 133 has one side in communication with one top bridging notch 1321 and the opposite side in communication with one bottom bridging notch 1322.

The ferrite core set 2 comprises two first ferrite cores 21 and two second ferrite cores 22. The first ferrite cores 21 are straight bars fitting the center through holes 11 of the bobbins 1. The second ferrite cores 22 are E-shaped ferrite cores, each having three protruding portions 221 perpendicularly extending from the center and two distal ends of its one side.

During installation, enabled wires are respectively wound round the primary sides 12 the and secondary sides 13 of the bobbins 1 to form a respective primary winding 121 and a respective secondary winding 134 at each bobbin 1. After winding of one wire in one winding space 131, the wire is extended through the bottom bridging notch 1322 of the partition flange 132 at one side of the respective winding space 131 to the adjacent vacant space 133 and then extended from the adjacent vacant space 133 through the top bridging notch 1321 into a next winding space 131 and then wound round the respective bobbin 1 in this next winding space 131, and then extended out of the next winding space 131 through the bottom bridging notch 1322 of the partition flange 132 at one side of this next winding space 131 to a next adjacent vacant space 133 and then a further next winding space 131 and continuously wound round the bobbin 1 in the same manner until formation of the secondary winding 134. After formation of the respective primary winding 121 and secondary winding 134 at each bobbin 1, the two first ferrite cores 21 are respectively inserted into the center through holes 11 of the bobbins 1, and then the two bobbins 1 are arranged together in a parallel manner, and then the two second ferrite cores 22 are respectively attached to the bobbins 1 to insert the respective middle protruding portions 221 into the side through holes 141 of the partition spaces 14 and to abut the respective three protruding portions 221 against the two first ferrite cores 21 respectively. Therefore, each second ferrite core 22 forms with the associating first ferrite core 21 a respective magnetic loop, i.e., the ferrite core set 2 provides two separated magnetic loops.

Figure 5:
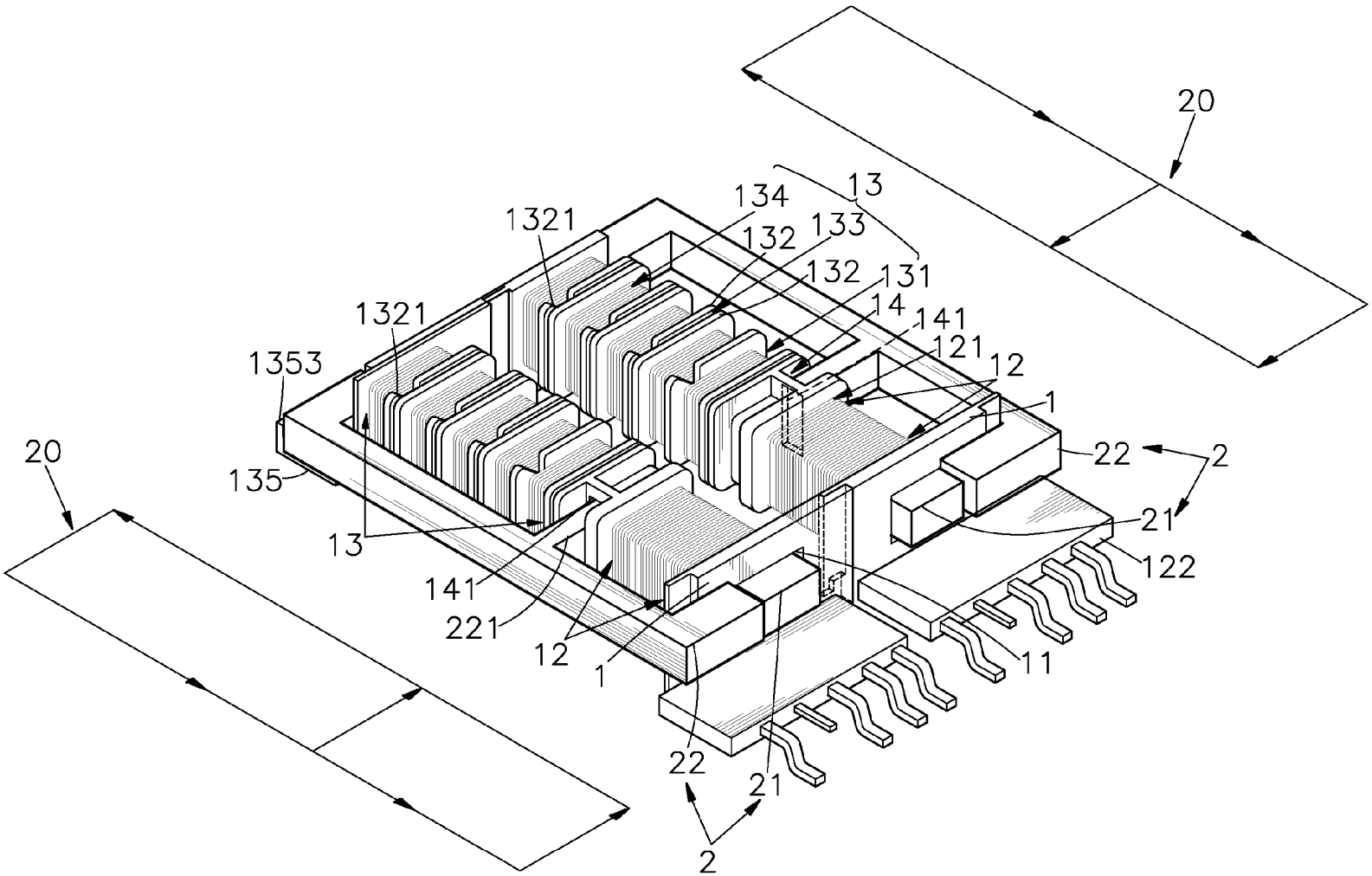
FIG. 5 is a schematic drawing of the first embodiment of the present invention, showing two independent magnetic loops produced during operation of the transformer.

Referring to FIG. 5 and FIGS. 2 and 4 again, by means of the aforesaid two magnetic loops, the primary winding 121 and the secondary winding 134 at each bobbin 1 form a respective magnetic loop 20, i.e., the transformer provides two independent magnetic loops 20 that do not interfere with each other, and therefore the secondary windings 134 at the two bobbins 1 provide an equal output to a respective load (lamp tube). Further, the induction between the protruding portions 221 and the respective secondary windings 13 greatly increases the leakage inductance and the coupling effect of the transformer, providing the desired resonance.

Further, the vacant spaces 133 defined between each two adjacent partition flanges 132 around the periphery of each bobbin 1 prevents protruding of the respective wire over the outside of the partition flanges 132 and keep the wire lead-in location and lead-out location apart to extend the creepage distance between each two adjacent winding spaces 131, thereby eliminating the problem of potential difference, enhancing the voltage resistance strength of the transformer, and prolonging the working life of the transformer. Further, the second locating block 135 at the outer side of the secondary winding 134 at each bobbin 1 has a perpendicularly extending stop flange 1353 for stopping the associating first ferrite core 21 and the second ferrite core 22 in place to extend the creepage distance between the ferrite core set 2 and terminals at each bobbin 1, enhancing the voltage resistance strength of the transformer.

Referring to FIGS. 1 and 4 again, male coupling means and female coupling portion, for example, coupling tongues 1221 and 1351 and coupling holes 1222 and 1352 are respectively provided at the first locating blocks 122 and the second locating blocks 135 of the bobbins 1. By means of engaging the respective coupling tongues 1221 and 1351 into the respective coupling holes 1222 and 1352, the two bobbins 1 are fastened together.

Figure 6A:
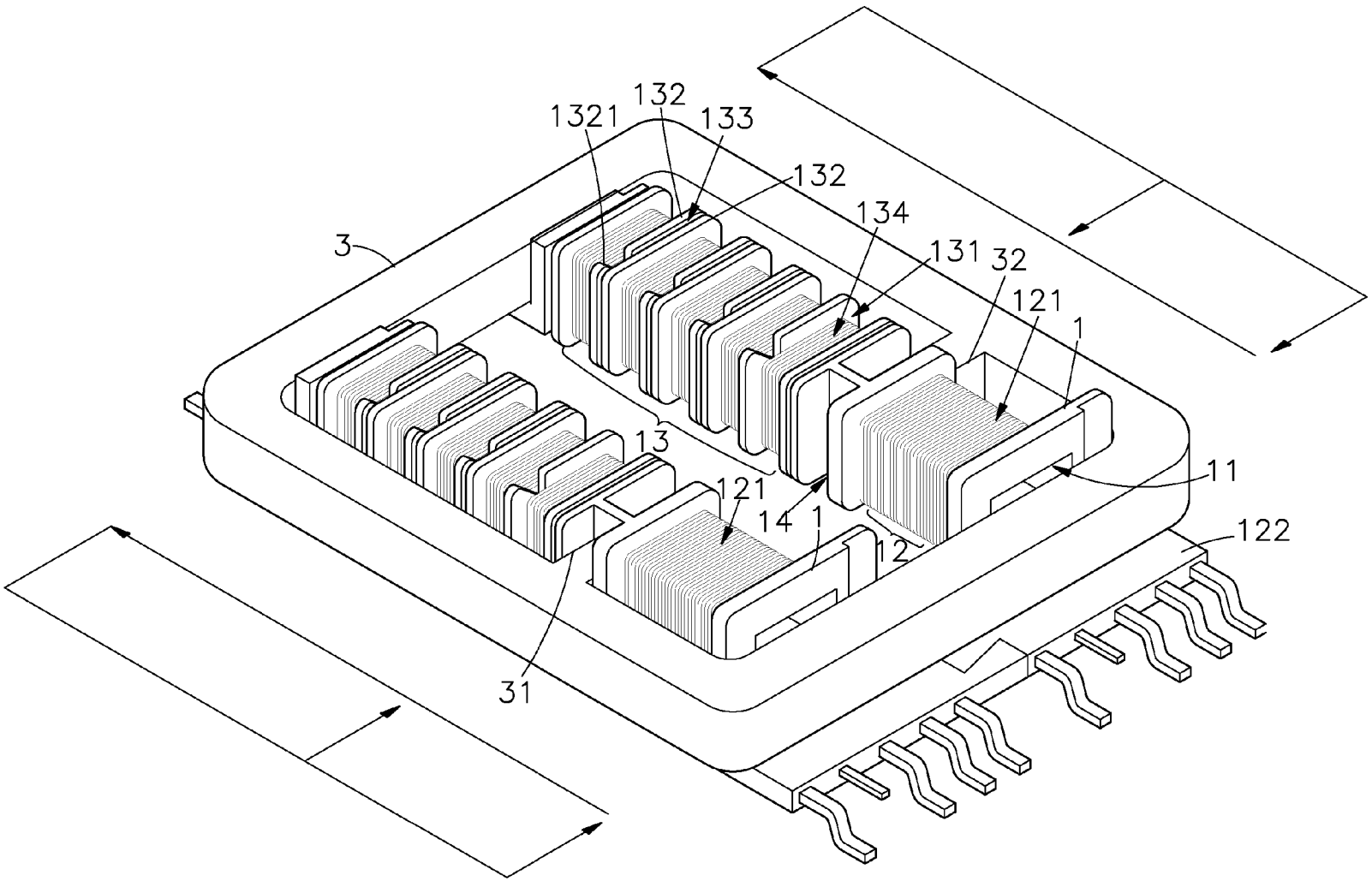
FIG. 6A is an elevational assembly view of a transformer in accordance with a second embodiment of the present invention.
Figure 6B:
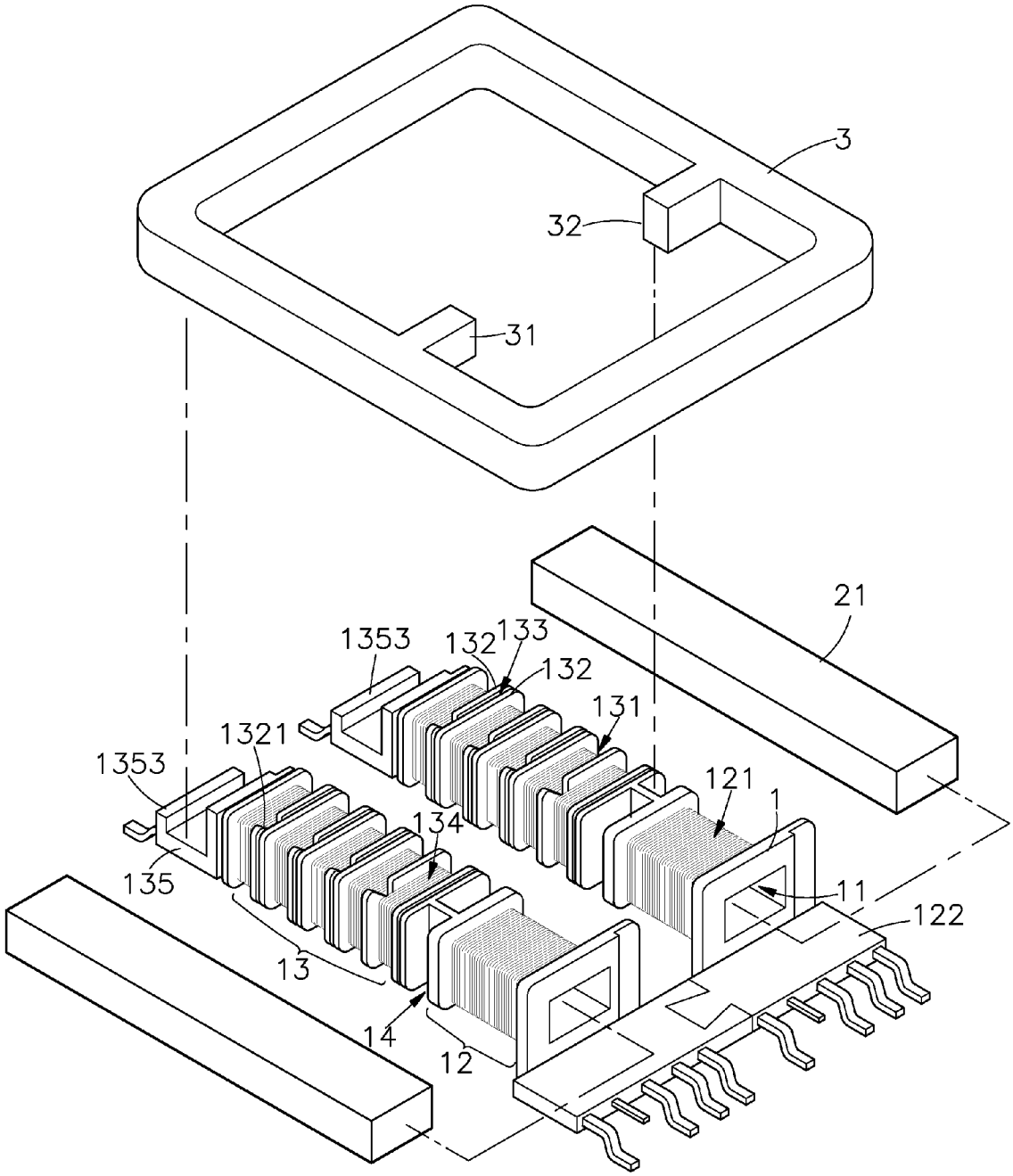
FIG. 6B is an exploded view of the transformer in accordance with the second embodiment of the present invention.
Figure 7:
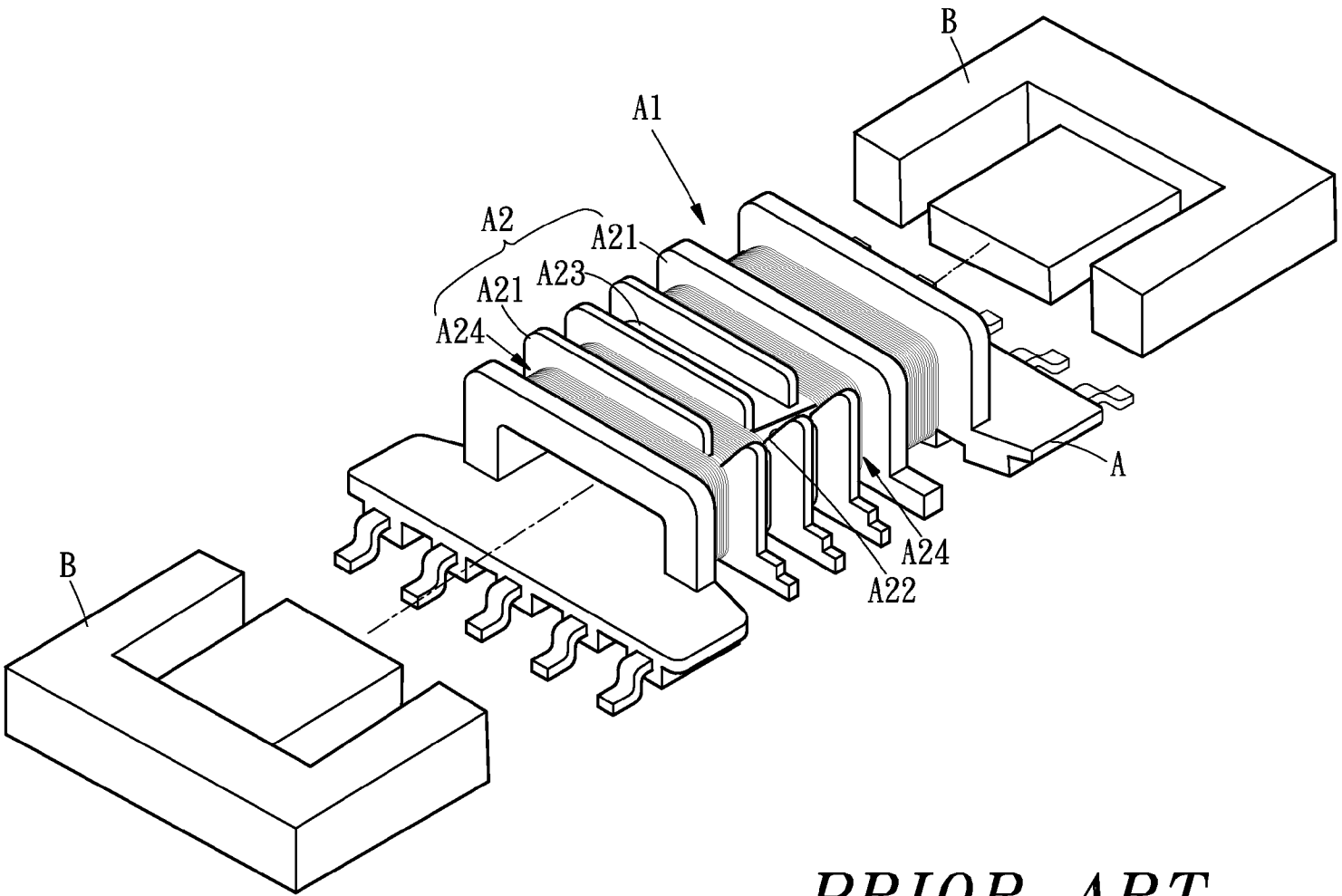
PRIOR ART FIG. 7
FIG. 7 is an exploded view of a transformer according to the prior art.
Figure 8:
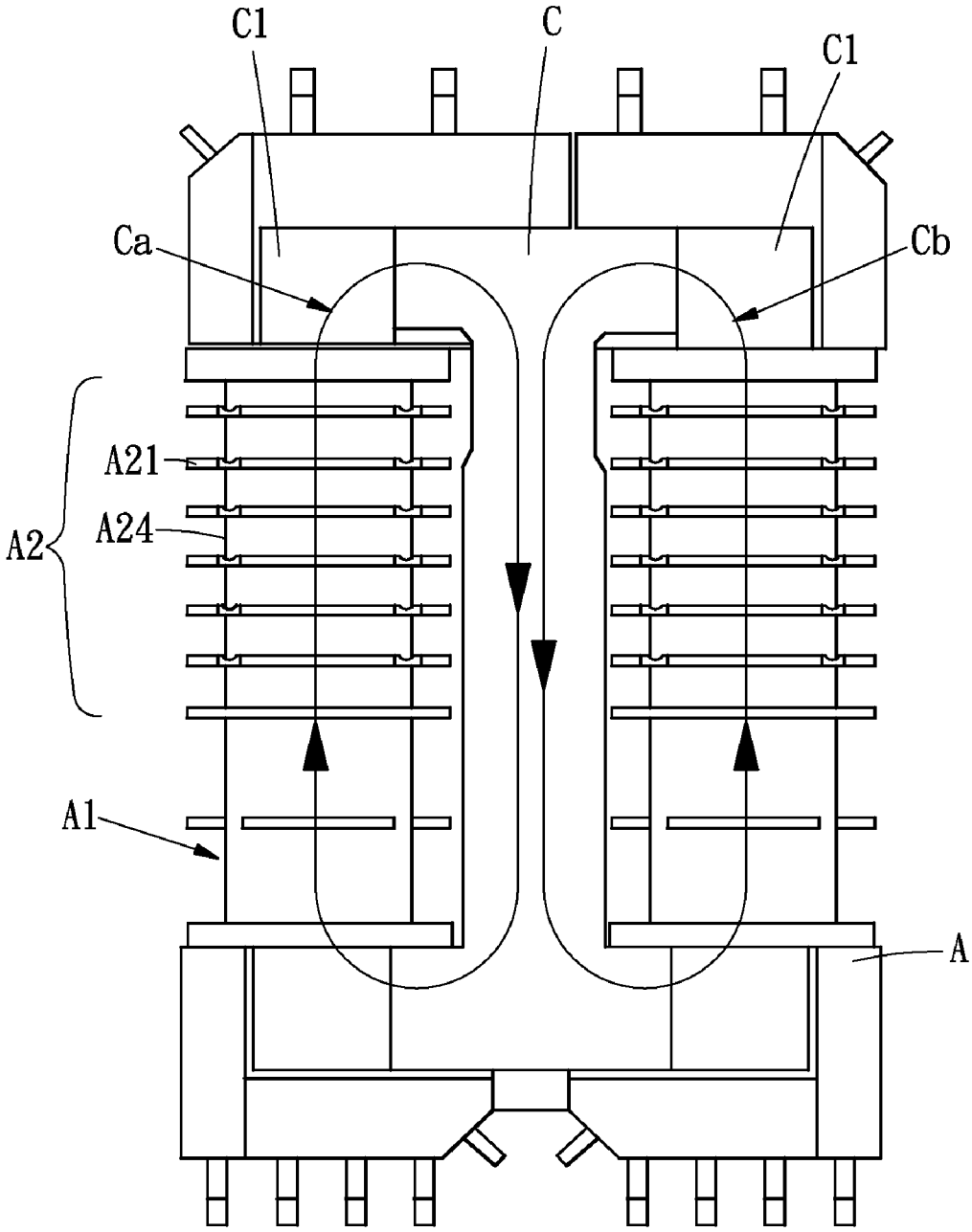
PRIOR ART FIG.8
FIG. 8 is a schematic top view of another design of transformer according to the prior art.

Referring to FIGS. 6A and 6B show an alternate form of the present invention. This embodiment is substantially similar to the embodiment shown in FIGS. 1~5 with the exception of the use of one rectangular frame-like ferrite core 3 to substitute for the aforesaid to E-shaped second ferrite cores 22. The rectangular frame-like ferrite core 3 has two protruding portions 31 and 32 bilaterally suspending on the inside for engaging into the side through hole 141 of the partition spaces 14 of the bobbins 1 so that the rectangular frame-like ferrite core 3 can form with the first ferrite core 21 in each bobbin 1 a respective independent magnetic loop. The induction between the protruding portions 31 and 32 and the respective secondary windings 134 at the bobbins 1 greatly increases the leakage inductance and the coupling effect of the transformer. By means of the independent first ferrite cores 21, the two magnetic loops thus formed are kept apart without interference, and therefore the transformer is capable of driving multiple lamp tubes.

In general, the invention provides an improved transformer structure, which has the following features and advantages:

1. Each bobbin 1 has a plurality of vacant spaces 133 defined around the periphery between each two adjacent partition flanges 132 and separated by the winding spaces 131 around the periphery of the respective bobbin 1 for the passing of the wire from one winding space 131 to another via the respective top bridging notches 1321 and the respective bottom bridging notches 1322, preventing a potential difference at the wire bridging area and eliminating the formation of an electric arc.

2. The vacant spaces 133 in the secondary side 13 of each bobbin 1 prevent the formation of a potential difference in the associating secondary winding 134, thereby enhancing the voltage resistance strength of the transformer and prolonging the working life of the transformer.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A transformer comprising:

two bobbin assemblies, said bobbin assemblies each comprising an electrically insulative bobbin, a primary winding and a secondary winding, said electrically insulative bobbin having an axially extending center through hole, a primary side and a secondary side extending around said axially extending center through hole around the periphery for supporting said primary winding and said secondary winding, and a partition space extending around the periphery between said primary side and said secondary side; and an ferrite core set installed in said bobbin assemblies, said ferrite core set comprising two first ferrite cores respectively fitted into said axially extending center through holes of said electrically insulative bobbins, and at least one second ferrite core disposed outside said electrically insulative bobbin and abutted against said first ferrite cores;

wherein said electrically insulative bobbin of each of said two bobbin assemblies each comprises a plurality of partition flanges extending around the periphery in said secondary side of said respective electrically insulative bobbin, a side through hole cut through the periphery in communication between said partition space and said center through hole of said respective electrically insulative bobbin, a plurality of winding spaces extending around the periphery of said respective electrically insulative bobbin and separated by said partition flanges, a plurality of vacant spaces defined between each two adjacent partition flanges around said periphery of the respective electrically insulative bobbin and separated by said winding spaces, a plurality of top bridging notches and bottom bridging notches respectively formed on said partition flanges such that said vacant spaces each have one side in communication with one of said top bridging notches and an opposite side in communication with one of said bottom bridging notches; said at least one second ferrite core of said ferrite core set comprises two protruding portions respectively inserted through said side through holes of said electrically insulative bobbins of said bobbin assemblies to form with said first ferrite cores two separated magnetic loops.

2. The transformer as claimed in claim 1, wherein said electrically insulative bobbins of said bobbin assemblies each comprise a locating block disposed at an outer side relative to said associating secondary side, said locating block having a perpendicularly extending stop flange for stopping said ferrite core set in place.

3. The transformer as claimed in claim 1, wherein said at least one second ferrite core of said ferrite core set comprises two E-shaped second ferrite cores respectively attached to said electrically insulative bobbins of said two bobbin assemblies from two opposite sides and abutted against each other.

4. The transformer as claimed in claim 1, wherein said at least one second ferrite core of said ferrite core set is a rectangular frame-like ferrite core, and said two protruding portions of said at least one second ferrite core respectively extend from two sides of said rectangular frame-like ferrite core in direction toward each other.

* * * * *